US009945392B2

(12) United States Patent
Dietzel et al.

(10) Patent No.: US 9,945,392 B2
(45) Date of Patent: Apr. 17, 2018

(54) HYDROPNEUMATIC DEVICE AND ASSEMBLY KIT

(71) Applicant: TOX PRESSOTECHNIK GMBH & CO. KG, Weingarten (DE)

(72) Inventors: Eberhard Dietzel, Weingarten (DE); Eugen Rapp, Ravensburg (DE)

(73) Assignee: Tox Pressotechnik GmbH & Co. KG, Weingarten (DE)

( * ) Notice: Subject to any disclaimer, the term of this patent is extended or adjusted under 35 U.S.C. 154(b) by 464 days.

(21) Appl. No.: 14/096,343

(22) Filed: Dec. 4, 2013

(65) Prior Publication Data

US 2014/0178214 A1 Jun. 26, 2014

Related U.S. Application Data

(63) Continuation of application No. PCT/EP2012/002335, filed on Jun. 1, 2012.

(30) Foreign Application Priority Data

Jun. 9, 2011 (DE) ..... 10 2011 105 212

(51) Int. Cl.
*F04F 7/02* (2006.01)
*F04B 53/16* (2006.01)
(Continued)

(52) U.S. Cl.
CPC ..... *F04F 7/02* (2013.01); *B21J 15/22* (2013.01); *F04B 53/16* (2013.01);
(Continued)

(58) Field of Classification Search
CPC . F04F 7/02; B21J 15/22; F15B 21/003; F15B 11/0325; F15B 3/00; F15B 7/04; F04B 9/103; F04B 9/105; F04B 53/16
(Continued)

(56) References Cited

U.S. PATENT DOCUMENTS 4,961,317 A * 10/1990 Wolfbauer, III .... F15B 11/0325 60/560
5,107,681 A * 4/1992 Wolfbauer, III .... F15B 11/0325 60/547.1
(Continued)

FOREIGN PATENT DOCUMENTS

DE 24 32 835 A1 1/1976
DE 100 23 297 A1 11/2001
(Continued)

OTHER PUBLICATIONS

German Search Report (Application No. 10 2011 105 212.0) dated Jan. 23, 2012.
(Continued)

*Primary Examiner* — Essama Omgba
*Assistant Examiner* — Stephen Mick
(74) *Attorney, Agent, or Firm* — Burr & Brown, PLLC

(57) ABSTRACT

A hydropneumatic device having pressure a working part with a working piston guided in the working part and an intensifier part with an intensifier piston guided in the intensifier part. A connecting section for a hydraulic connection of the working part and of the intensifier part provides a connecting line for passage of hydraulic fluid between the working part and the intensifier part. The connecting section includes an adapter component which can be mounted on the working part and the intensifier part, and in the interior of which the connecting line is formed. In the mounted state of the adapter component, an opening, which is provided at the side on the working part, of a hydraulic chamber of the working part is connected, via the connecting line, to an opening, which is provided at the side on the intensifier part, of a hydraulic chamber of the intensifier part.

12 Claims, 3 Drawing Sheets

(51) Int. Cl.
*F15B 11/032* (2006.01)
*F15B 21/00* (2006.01)
*B21J 15/22* (2006.01)

(52) U.S. Cl.
CPC ..... *F15B 11/0325* (2013.01); *F15B 21/003* (2013.01); *Y10T 29/49236* (2015.01)

(58) Field of Classification Search
USPC ..... 417/226, 360; 60/481; 285/124.5
See application file for complete search history.

(56) References Cited

U.S. PATENT DOCUMENTS 5,526,644 A * 6/1996 Brieschke ..... F15B 3/00 60/565
5,634,779 A * 6/1997 Eysymontt ..... F04B 9/1178 417/342
5,860,676 A * 1/1999 Brzezicki ..... F15B 13/0817 137/884
2007/0199604 A1 8/2007 Haugaard
2008/0245067 A1 10/2008 Rapp et al.
2009/0038470 A1 2/2009 Schad et al.

FOREIGN PATENT DOCUMENTS

DE 103 17 412 A1 2/2004
DE 20 2004 019 993 U1 4/2005
DE 103 43 330 A1 4/2005
DE 10 2006 045 258 A1 4/2008
DE 10 2008 013 374 A1 10/2008
DE 10 2007 030 400 A1 1/2009
DE 10 2007 036 844 A1 2/2009

OTHER PUBLICATIONS

International Search Report and Written Opinion (Application No. PCT/EP2012/002335) dated Jan. 18, 2013.

* cited by examiner

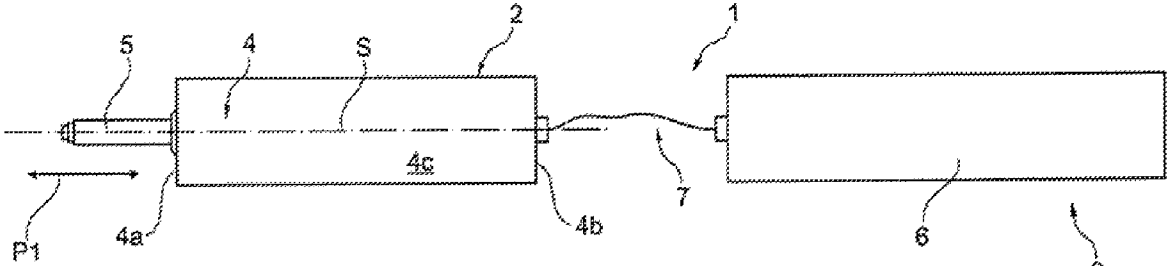
Fig. 1 PRIOR ART
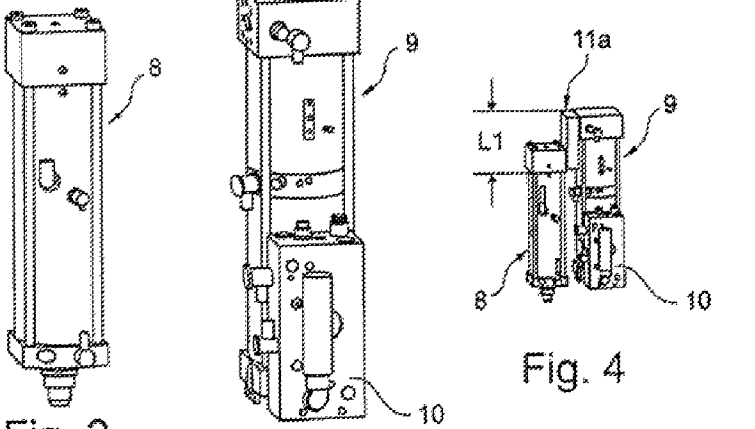
Fig. 2
Fig. 3
Fig. 4
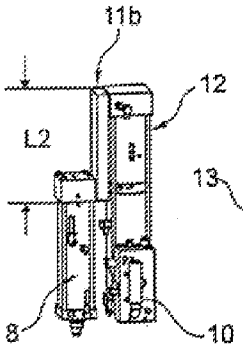
Fig. 5
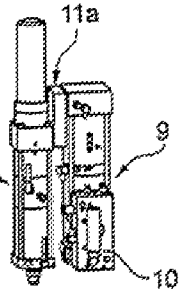
Fig. 6

HYDROPNEUMATIC DEVICE AND ASSEMBLY KIT

CROSS REFERENCE TO RELATED APPLICATIONS

This application is a continuation of International Application No. PCT/EP2012/002335 filed Jun. 1, 2012, which designated the United States, and claims the benefit under 35 USC § 119(a)-(d) of German Application No. 10 2011 105 212.0 filed Jun. 9, 2011, the entireties of which are incorporated herein by reference.

FIELD OF THE INVENTION

The invention relates to a hydropneumatic device and assembly kit.

BACKGROUND OF THE INVENTION

Hydropneumatic devices, such as pneumohydraulic drive systems, especially with integrated pressure intensification, are known. Such devices are used, for example, as pressing arrangements for various tasks, such as for pressing on or pressing in, joining by deformation or for press-fitting, clinching, riveting, punch riveting, solid punch riveting or semi-hollow punch riveting. Essential components of a hydropneumatic device are, for example, an intensifier part with an intensifier piston, which is movable in a linearly guided manner, and a working part, wherein a working piston executes a reciprocating movement in the working part during operation. The working piston as a rule is moved forward in a rapid traverse either pneumatically or hydraulically up to a desired position, wherein after coming up against a component, a power stroke commences. During this, from, for example, a pneumatic low pressure of 2 to 10 bar—which acts upon the intensifier piston and moves this so that hydraulic fluid flows from the intensifier part into the working part—a high hydraulic pressure of 250 to 400 bar, for example, is generated in the intensifier part and acts upon a hydraulic surface on the working piston and moves this so that a high pressing force is created during the power stroke. With a return stroke of the working piston and intensifier piston, which is carried out in a direction opposite to the movement of the working piston or intensifier piston during the rapid traverse stroke and power stroke, the working piston and the intensifier piston are brought into an initial position, which in particular is carried out pneumatically by switching of an air pressure to a return-stroke side of the two pistons of the working part and intensifier part.

The working part and the intensifier part are hydraulically interconnected via a connecting section, as a result of which in a connecting line of the connecting section a bidirectional passage of hydraulic fluid is provided between the working part and the intensifier part. The connecting line connects a hydraulic interface point on the working part to a hydraulic interface point on the intensifier part.

In a hydropneumatic device, the components or the working part and the intensifier part have to be designed in each case in a way in which they are matched to each other. Starting from a considered configuration, each change in one of the two components necessitates a change in the other component. A change can especially be necessary as a result of adapting a hydropneumatic device to other design values, such as pressure values and/or stroke length values.

SUMMARY OF THE INVENTION

It is the aim of the present invention to improve the economic efficiency of the devices referred to in the introduction, especially with regard to different designs of the hydropneumatic devices.

The invention is first of all based on a hydropneumatic device with pressure intensification, wherein the hydropneumatic device has a working part with a working piston guided in the working part and an intensifier part with an intensifier piston guided in the intensifier part, wherein a connecting section is provided for a hydraulic connection of the working part and of the intensifier part and provides a connecting line for a passage of hydraulic fluid between the working part and the intensifier part. An essential aspect of the invention lies in the fact that the connecting section comprises an at least essentially rigid adapter component which can be mounted on the working part and on the intensifier part and in the interior of which the connecting line is formed, wherein in the mounted state of the adapter component an opening—which is provided at the side on the working part—of a hydraulic chamber of the working part is connected, via the connecting line, to an opening—which is provided at the side on the intensifier part—of a hydraulic chamber of the intensifier part.

An opening provided at the side in this context means that the opening is provided in an outer housing section, for example, e.g. a casing-housing section, which circumferentially encompasses the working piston or intensifier piston, or a hydraulic chamber in the interior of the working part or intensifier part terminates there. Consequently, a lateral access, or an access with a direction which is at an angle to the longitudinal direction of the working piston or intensifier piston, is provided. The connecting line in the adapter component in the mounted state aligns in each case with the corresponding ends at ends of a line section or hydraulic chamber section in the working part and in the intensifier part.

With the connection at the side, an end-face-side housing section of the working part or intensifier part can remain free of an opening or of the adapter component, which is advantageous with regard to a reduced total length of the working part and/or intensifier part, for example.

With the hydropneumatic device according to the invention, an advantageous standardization of the components is provided. In particular, manufacture with large batch sizes is advantageously possible.

Previously, each change in one of the components of the hydropneumatic device, which was dependent upon the design of the respective hydropneumatic device, also necessitated a change in the other components. This is predetermined by constructional relationships which are clarified in more detail below. For a considered number of different hydropneumatic devices, for each of the components an associated type of the other components is to be accurately selected.

For the design of a hydropneumatic device, a total stroke of the hydropneumatic device, for example, is fundamental. The total stroke or the maximum possible stroke length results from the maximum permissible rapid traverse stroke and the maximum possible power stroke of the working piston. Also determined by a maximum possible stroke length of the working piston is the total length of the working part. For the reciprocating movement of the working piston, an oil volume which corresponds to the total stroke of the working piston is in turn required in a storage chamber in the intensifier part. Moreover, a stroke, which is to be designed in advance, of the intensifier piston in the intensifier part, is to be provided for a desired power stroke in the working piston.

Consequently, for the stated reasons the working part and the intensifier part have to be individually matched to each other in each case. Each change to one of the values of "total stroke" and/or "power stroke" involves a length change of the entire device or of the hydropneumatic device and therefore of each of the plurality of affected components on the working part and on the intensifier part. For a stroke change or length change, the working part usually has to be modified, for example lengthened, by means of at least one intermediate piece in order to be able to adapt the working part to the also differently predeterminable length of the associated intensifier part. Also, the connecting section, which was previously connected in the end-face end region of the working part and intensifier part, had to be adapted until now. These measures, or this length dependency of the working part and of the intensifier part, are, or is, disadvantageous for standardization of components or for production with larger batch sizes.

These disadvantages are remedied according to the present invention. With the connection of the adapter component at the side in each case, the length change in the intensifier part has no effect upon the working part, and vice versa. Compared with the previous procedure, only comparatively few constructionally graded components are required for compiling a desired number of grades in the design. The cost of production and storage is considerably less compared with the previous situation and the invention is therefore economically advantageous.

With a comparatively noticeably reduced kit of a component—wherein the kit consists of constructional grades of components with the same basic construction or consists of components which are distinguished from the construction volume, the same design scope can be covered, for which a large number of components was previously necessary. For example, compared with the previously required total number of components, according to the invention it is possible to get by with about a third of the components in order to cover the corresponding combinations.

It is especially advantageous that the combinations can be realized for the most part by differently designed adapter components which are constructionally comparatively simple compared with the working part and intensifier part. For a broad diversification of the design of the overall arrangement or of the hydropneumatic device, which for example concerns different total strokes or power strokes, only comparatively few differently designed intensifier parts, for example in a kit of types of intensifier parts, are necessary. A still wider range of design possibilities can be achieved, moreover, by means of particularly few differently configured working parts in a kit of types of working parts.

In particular, provision can be made according to the invention for a connecting principle according to which the working and intensifier parts can be of a standardized construction so that any combination of the respective intensifier parts with the respective working parts is possible, forming correspondingly different hydropneumatic devices.

It is particularly advantageous in this case that with the invention a working part and intensifier part can be hydraulically connected in different ways, for example via a rigid system or via a system with flexible connecting means.

As a result, any combination possibilities of intensifier parts, which are differently dimensioned but of the same type as the basic construction, with at least one type of working part, are economically advantageously possible.

It is also advantageous that the adapter component is designed in such a way that the adapter component in the mounted state is supported on the working part and the intensifier part by oppositely disposed main faces provided on the adapter component. In particular, the adapter component is supported in a flat manner via its oppositely disposed main faces on similarly flat or planar mating sections on the working part and intensifier part. The oppositely disposed main faces of the adapter component are especially of a similar design. The mating sections on the intensifier part and working part are also preferably of the same design. Consequently, the attachment or mounting of the adapter component or the assembly of the hydropneumatic device is possible in an especially effective and simple manner.

The main faces on the adapter component and the associated mating sections on the working part and intensifier part are in surface contact with each other in the mounted state of the adapter component, especially, for example, by means of mutually abutting planar surfaces in each case, which are pressed against each other. Consequently, a high degree of leakproofness can be ensured in order to safeguard against the escape of hydraulic fluid. Furthermore, via the surface support a comparatively high degree of stability in the connecting region of the intensifier part to the working part, and therefore also of the overall arrangement, is advantageously achieved.

In principle, a non-flat support, e.g. via only reduced support sections, on the adapter component or on the working part and/or on the intensifier part is also possible.

It is also advantageous that provision is made on the working part and on the intensifier part for an end section, as seen in the longitudinal direction, on which the adapter component is supported in the mounted state. The support is effected especially by means of flat pressing on. An end section for example can be a separate part which can be attached on the working or intensifier parts. As a rule, an end section is provided in each case on a basic body of the working part and of the intensifier part, as seen in the longitudinal direction, on the end-face longitudinal ends. The basic body especially comprises a housing section, with the working piston or intensifier piston guided inside, and a pneumatic or hydraulic chamber. An end section terminates one end of the basic body with sealing effect. At the other end of the basic body, the other end section provides a line section via which hydraulic fluid from a hydraulic chamber in the interior of the basic body, e.g. of the intensifier part, is directed to a side opening on the outside on the end section from which, in the mounted state of the adapter component, the hydraulic fluid can flow through the adapter component and, via an opening on the end section of the working part, can make its way into a hydraulic chamber of the basic body of the working part and flow back again.

The two end-face end sections on a basic body are preferably separate components, for example end flanges of for example cylinder covers, and by means of four elongated tie rods, for example, which extend at a distance on the outside along the basic bodies, can be pressed against the end-face ends of the basic bodies. For this purpose, screw-nuts can be screwed from the outside onto a mating male threaded section on the ends of the tie rods which in a projecting manner extend through openings on at least one end section.

According to an advantageous embodiment of the subject matter of the invention, the adapter component is designed essentially as a cubic component with prepared attachment openings through which extend fastening means for mounting the adapter component on the working part and on the intensifier part. As a result, production of the adapter component can be carried out comparatively simply and economically advantageously. The fastening means preferably extend laterally completely through a width of the adapter component, especially perpendicularly to the oppositely disposed main faces in the anchoring openings on the working part and intensifier part. In this way, the fastening means, such as threaded means, are aligned in the normal or perpendicular direction with the main faces and with the flat mating sections on the end sections in the mounted state of the adapter component. For this purpose, corresponding through-holes or a corresponding hole pattern are, or is, to be provided in the adapter component for the fastening means, preferably in the region around a passage opening—provided in each case in the main faces—for passage of hydraulic fluid between the adapter component and the intensifier part or working part. For connecting the adapter component to the intensifier part and to the adapter part, four screws are advantageously provided in each case, whereby altogether eight screws are required for the complete mounting of the adapter component.

An advantageous variant of the subject matter of the invention is distinguished by the fact that the end section on the working part and the end section on the intensifier part are matched to the associated attachment openings on the adapter component for mounting the adapter component on the working part and on the intensifier part by the fastening means. Consequently, a hole pattern corresponding to the relevant hole pattern on the adapter component is to be provided on the associated mating section. The hole pattern is especially preferably on the one main face of the adapter component, which is provided for attaching the adapter component on the intensifier part, coinciding with the hole pattern on the opposite main face of the adapter component, which is provided for attaching the adapter component on the intensifier part. With the uniform hole pattern on the main faces of the adapter component, the associated hole pattern on the intensifier part and the working part is naturally also uniform. As a result, it is advantageously possible to selectively mount an adapter component by a main face on the intensifier part or the working part. Furthermore, when selecting a corresponding or symmetrically designed hole pattern, attachment of the adapter component is possible in differently rotated orientations, e.g. a position of the adapter component rotated by 180 angular degrees starting from a first attachment orientation, and a rotation around an axis which runs centrally through a hydraulic fluid opening in a main face of the adapter component. As a result, the orientation of the intensifier part relative to the working part in the hydropneumatic device can be varied in an advantageous way.

For both openings of the connecting line in the adapter component, wherein an opening is provided on each of the main faces, provision is preferably made in each case for four through-holes for passage of the fastening means, which through-holes are formed circumferentially around the opening in a uniformly displaced manner, in relation to each other.

It is also advantageous that the end section on the working part and the end section on the intensifier part are similarly designed in each case for mounting the adapter component on the working part and on the intensifier part. In this way, the adapter component can be selectively located by a main face on the working part or on the intensifier part for the mounting.

It is also advantageous that the connecting line in the adapter component has a section which in the mounted state of the adapter component extends in the longitudinal direction of the intensifier part and of the working part. Especially when the longitudinal axes of the intensifier part and of the working part are at least approximately in parallel alignment, a gap in the longitudinal direction of the intensifier part and working part between the openings in the working part and intensifier part, which are to be connected via the connecting section or the adapter component, can be overcome by means of this connecting line section in the mounted state of the adapter component. Length differences between the intensifier part and the working part, which are regularly the case, can be compensated in this way. To this end, the corresponding length of the connecting line section or, if applicable, of the adapter component is to be designed on its own. The width of the adapter component can remain the same in each case, uninfluenced by this. So that a lateral spacing of intensifier part and working part remains constant, when using a kit of different types of adapter components, which differ only in the length of the connecting line section or of the adapter component, the lateral spacing can especially be kept comparatively small. The lateral spacing is especially determined on its own by the width of the adapter component, or by the spacing of the two main faces of the adapter component, which in turn depends on the diameter of the connecting line section and on the thickness of wall sections of the adapter component, wherein the wall sections in the relevant direction adjoin the connecting line section on both sides.

In the mounted state, the working part and the intensifier part can therefore be positioned comparatively closely together in a width direction, as a result of which the entire hydropneumatic device is of an advantageously compact construction in width.

The present invention also relates to an assembly kit with components of a hydropneumatic device for providing a hydropneumatic device, the assembly kit comprising an intensifier part and a working part which is hydraulically connected thereto via a connecting section, wherein the assembly kit comprises a plurality of different types of intensifier part and at least one type of working part, and also a kit of types of an adapter component, wherein a hydraulic connection of any type of intensifier part to the at least one type of working part can be realized by means of a matching type of adapter component from the kit of types of adapter component, wherein an adapter component is designed essentially as a rigid component.

The adapter component in this case preferably provides the complete connecting section between the intensifier part and the working part, especially with no flexible line sections, such as in the case of a hose connection, being provided.

Up to now, hydropneumatic devices were assembled depending on application or with regard to desired maximum power values and stroke distances of the working piston, wherein each intensifier part was to be individually matched to the respective working part. Adaptation of the entire system usually necessitated in each case adaptation of the working part and of the intensifier part or, if applicable, of further components, like the connecting section. With the assembly kit according to the invention, the advantages already referred to above for the hydropneumatic device are realized with regard to economic advantages.

It is especially advantageous that the kit of types of adapter components comprises different adapter components, wherein each adapter component of the plurality of different adapter components is designed in each case in a way in which it is matched to one of the different intensifier parts and to the at least one working part, wherein simply by selecting a suitable adapter component from the kit of types of adapter components and by mounting it on the relevant intensifier part and the relevant working part, a desired combination of an intensifier part of the plurality of different intensifier parts in each case with the at least one working part is realized.

By means of the adapter components, that is to say by mounting them on the relevant working part and intensifier part, a plurality of differently configured hydropneumatic devices can be provided without an adaptation to the working part and intensifier part being necessary in each case. Only comparatively few differently designed intensifier parts, a kit of types of adapter component and only one working part, or only a few differently designed working parts, are necessary. Up to now, the provision of corresponding hydropneumatic devices was possible only with a many times higher cost of components or of storage and with a higher labor cost. In particular, the provision of the kit of types of adapter component is comparatively less costly than modification or diversification of different working parts and intensifier parts.

It is also advantageous that an adapter component from the kit of types of adapter components is matched to a mounting section on an intensifier part and a working part so that the mounting of the adapter component on the intensifier part and the working part is carried out in each case via at least one connecting element which extends laterally through the adapter component. As a connecting element, particularly an elongated or slim plug-in element, or a connecting screw and the like, is a possibility. In particular, a plurality of connecting screws, for example four, are provided, wherein provision is made in each case for corresponding through-openings on the adapter side and for openings with anchoring sections or female threads on the working part side or intensifier part side.

In the mounted state of the adapter component, a first connecting element advantageously engages in a prepared opening in the mounting section of the intensifier part and a second connecting element advantageously engages in a prepared opening in the working part. As a result, a similar type of connecting arrangement of the adapter component is provided for the working part and also for the intensifier part. This is advantageous with regard to the mounting or to the provision of corresponding connecting elements and also for the production of the adapter component and of the corresponding mating sections on the working part and intensifier part.

Finally, it is also advantageous that provision is made for a kit of types of a hose adapter component which has a flexible connecting line section, wherein the hydraulic connection of any type of intensifier part to the at least one type of working part can be selectively realized with a matching type of adapter component or with a matching type of hose adapter component from the kit of types of hose adapter component. In principle, therefore, the advantages for components of the hydropneumatic device which are connected via flexible line sections, or components of an attachment of working parts and intensifier part which are at greater distances from each other, can be realized. In this case, it is advantageous that the design of the at least one working part and of the kit of types of intensifier components remains uninfluenced thereby.

Preferably, not only one type of working part, but a kit of types of working parts is provided in the assembly kit.

According to the invention, simplex systems and multiplex systems, which are connected via high-pressure hoses, for example, can be advantageously realized. A simplex system is distinguished by just one intensifier part and just one associated working part which are hydraulically interconnected. A multiplex system consists of an intensifier part which is hydraulically connected to a plurality of working parts, which is especially realized via flexible connecting systems. In this case, all the working parts or only individual working parts of the plurality of working parts can be actuated by the hydraulically connected intensifier part.

With the assembly kit according to the invention, it is possible to realize a wide spectrum of combinations of hydropneumatic devices with different total strokes and power strokes using a comparatively small number of differently configured working parts and intensifier parts.

According to the invention, all types of working parts and intensifier parts are constructed with a standardized screw-hole pattern which is suitable both for the screw fastening for a rigidly connected hydropneumatic device and for the attachment of a hose system, or a plurality of hose systems, for example, via a special hydropneumatic connection for a hose system.

For example, an intensifier part can be associated with each working part from a kit of types of working parts, wherein the intensifier part is designed with a step. An intensifier step is created when the diameter of the intensifier part is greater by a dimension than the diameter of the working part.

As a result, a total length of the hydropneumatic device and a rapid traverse stroke volume can be matched to the respective working part. Therefore, different embodiments can be realized, having 12 to 15 millimeters of power stroke, for example, depending on overall size. Intensifier parts which allow a total stroke of 100 millimeters and a power stroke of 6 millimeters are designed for, and matched to, smaller overall sizes.

By the same token, it is possible to selectively add an intensifier part with two or three intensifier steps to a considered working part.

Therefore, a power stroke of between 20 and 100 millimeters, for example, can be provided. The required rapid traverse stroke volume is sufficient on account of the dimensioning described above.

In addition, a maximum overall length, which is designed for the maximum column length of a plunger of the hydropneumatic device, can be matched to each type of intensifier parts. The rapid traverse stroke volume results in this case from a plunger length in a high-pressure tube.

With the adapter component, only a single length-dependent component, so to speak, is used in a hydropneumatic device. In this case, the intensifier part can be designed for the working part both in standard build form, according to which the intensifier part is oriented downward, and in a so-called Z-build form, in which the intensifier part extends upward. An embodiment which is rotated by 90° to this can also be mounted.

All the combinations of intensifier parts with working parts can also be realized with a total stroke adjustment. The total stroke can be variably predetermined there on the hydropneumatic device itself, for example by means of manually operable adjustment means.

Also, the addition of further functions, such as damping of cutting impact, press-in damping, distance measuring, etc., is possible without any problem in the case of the assembly kit according to the invention or the hydropneumatic device according to the invention.

BRIEF DESCRIPTION OF THE DRAWINGS

Further features and advantages of the invention are explained in more detail based on different exemplary embodiments according to the invention which are shown in the figures.

FIG. 1 is a schematic side view of a known hydropneumatic device;

FIG. 2 is a perspective view of a working part of a hydropneumatic device according to the invention;

FIG. 3 is a perspective view of an intensifier part of a hydropneumatic device according to the invention;

FIGS. 4 to 6 each show a perspective hydropneumatic device according to the invention with a working part and an intensifier part in the assembled state;

DETAILED DESCRIPTION OF THE DRAWINGS

Figure 7:
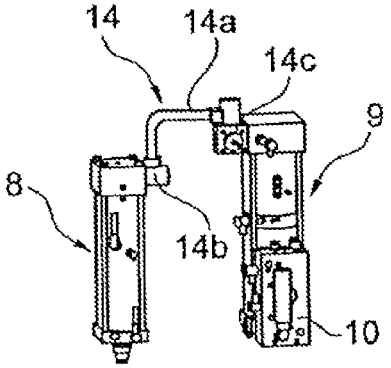
FIGS. 7 to 9 are perspective views each showing further hydropneumatic devices according to the invention with an intensifier part and at least one working part in the assembled state.

In the figures, the same designations are used in part for corresponding elements in the different exemplary embodiments.

FIG. 1 shows a hydropneumatic device according to the prior art which by way of example is designed as a pneumohydraulic drive system or as a clinching or riveting device. The arrangement according to FIG. 1 is subsequently referred to as a pressure intensifier 1. The pressure intensifier 1 in essence comprises three basic components with a working part 2, an intensifier part 3 and a connecting section 7 with a hydraulic hose. The working part 2 comprises a working piston 5 which can move back and forth in a housing 4 of the working part 2 according to the double arrow P1. In FIG. 1, the completely extended position of the working piston 5 is shown, wherein the visible part in FIG. 1 of the working piston 5, which projects from an end-face housing section 4*a* of the housing 4, extends further into the interior of the working part 2. The housing 4, in the longitudinal direction of the working part 2, comprises a further end-face housing section 4*b* on the end side opposite the end-face housing section 4*a*, and between these comprises a lateral housing section 4*c*which delimits the working part 2 circumferentially around the longitudinal axis S thereof.

The working piston 5 executes the actual reciprocating movement during operation of the pressure intensifier 1, wherein the working piston 5 is moved forward in a rapid traverse stroke either pneumatically or hydraulically up to the desired position in the direction of a component (not shown) which is to be processed. The actual power stroke commences after contact is made with the component. In the process, a hydraulic high pressure of 250 to 400 bar, for example, is generated in the intensifier part 3 from a pneumatic low pressure of 2 to 10 bar, for example. This hydraulic high pressure acts upon the hydraulic surface of the working piston and so generates a desired high pressing force for the power stroke of up to 2000 kN, for example.

A return stroke of the working piston 5 and of an intensifier piston, which can also move back and forth in a housing 6 of the intensifier part 3 in the longitudinal direction according to the extension of the axis S, is carried out pneumatically in an initial position by switching air pressure to a return-stroke side of the two pistons of working part 2 and intensifier part 3.

The working part 2 and the intensifier part 3 are hydraulically interconnected via the connecting section 7 between the working part 2 and the intensifier part 3.

For the reciprocating movement of the working piston 5, an oil volume, which corresponds to the total stroke of the working piston 5, is required in a storage chamber in the intensifier part 3 and flows from a hydraulic volume provided in the intensifier part 3 into a hydraulic volume in the working part 2, and vice versa, so that a movement of the intensifier piston induces a movement of the working piston 5.

Not shown in FIG. 1 are further components on the pressure intensifier 1, such as a pneumatic control unit on the intensifier part 3. Such a pneumatic control unit 10 is visible in FIGS. 3 to 9.

For a desired power stroke on the working piston 5, a stroke of the intensifier piston, which is to be designed in advance, is to be provided on the intensifier part 3.

FIG. 2 shows a working part 8 of a hydropneumatic device according to the invention, for which FIG. 3 shows an intensifier part 9. The working part 8 and the intensifier part 9 can be assembled via an adapter component 11 (see FIG. 11), forming a hydropneumatic device according to the invention. The rigid or fixed adapter component 11 is designed here as a cube-like metal component with conducting line sections, provided inside, for the passage of hydraulic fluid.

The working part 8, the intensifier part 9 and the adapter component 11 are especially parts of an assembly kit according to the invention for providing a hydropneumatic device which is constructed from the components 8, 9 and 11 of the assembly kit.

Depending upon the intended application or design of the hydropneumatic device which is to be provided, a type of an intensifier part, adapter component and, if applicable, a working part is selected and assembled from a range or a kit of different types of the components, forming a desired hydropneumatic device. The different types of a respective component usually differ from each other only in a dimensional size which is not critical for the actual assembly. The respective design or the respective dimensions of the sections which is, or are, relevant for mounting on the intensifier part and working part does not, or do not, differ in the different types of kit of types of adapter components. This correspondingly applies in each case to the types from the kit of intensifier parts and working parts.

For assembling different combinations from the kit of types of intensifier parts and working parts, only the matching adapter component needs to be selected, which adapter components are also provided in a kit of different types or sizes in the assembly kit. The assembly kit therefore comprises in each kit a multiplicity of premanufactured similar components which differ from the other types only by design features.

Overall, therefore, the number of parts to be made available can be reduced or optimized and kept comparatively low.

FIGS. 4 to 6 show in each case different hydropneumatic devices according to the invention. FIGS. 4 and 5 show, for example, in each case an identical working part 8 which is connected via an adapter component 11*a* or 11*b* to a different type of intensifier part 9 or 12 in each case. The intensifier part 12 differs, for example, by its larger length dimension compared with the otherwise similarly constructed intensifier part 9. The intensifier parts 9 and 12 are different types of intensifier parts which belong to the same kit of types of intensifier parts. Also, the connecting intermediate elements or the adapter components 11*a* and 11*b* belong to a similar kit of types of adapter components. The adapter components 11*a* and 11*b* differ only in length, whereby the adapter component 11*a* has a shorter length L1 compared with the length L2 of the adapter component 11*b*, which corresponds to the length difference of the intensifier parts 9 and 12.

FIG. 6 relates to a further alternative hydropneumatic device according to the invention with a working part 13, the total stroke of which is adjustable and which is hydraulically connected via the adapter component 11*a* to the intensifier part 9. The working part 13 belongs to the same kit of types of working parts, wherein one type comprises the working parts 8 according to FIGS. 4 and 5 and another type of working parts comprises working parts according to working part 13. The intensifier part 9 according to FIG. 6 corresponds to the intensifier part 9 in FIG. 4, therefore the identical designation also corresponds.

Figure 8:
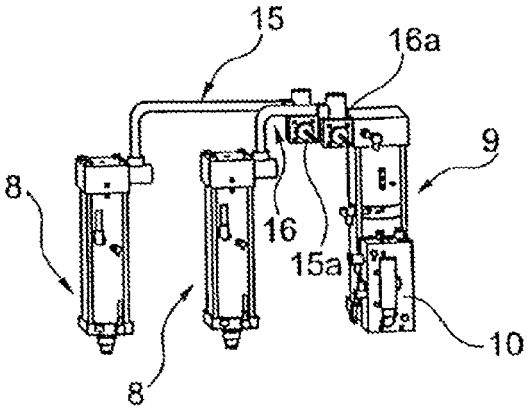
Figure 9:
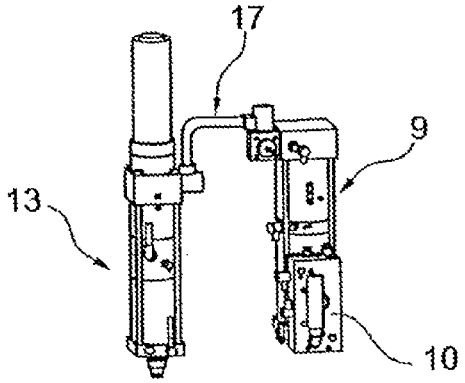

Shown in FIGS. 7 to 9 are hydropneumatic devices according to the invention which in each case comprise at least one hose adapter component from a kit of types of hose adapter components. The hydropneumatic device according to FIG. 7 is assembled from a working part 8 and an intensifier part 9, wherein the hydraulic connection between the working part 8 and the intensifier part 9 is realized by the hose adapter component 14. The hose adapter component 14 has a flexible hose section 14*a* between a rigid hose coupling part 14*b* on the working part 8 and a further rigid hose coupling part 14*c* on the intensifier part 9.

FIG. 8 shows an extension of the arrangement from FIG. 7 with a further working part 8, wherein a hose adapter component 16 corresponding to the hose adapter component 14 from FIG. 7 is provided. Furthermore, for the further working part 8 provision is made for a hose adapter component 15 with a hose coupling part 15*a* which is connected to the hose coupling part 16 which in turn is mounted on the intensifier part 9. Accordingly, almost any cascade-like extension of an intensifier part with a plurality of working parts is possible by means of a plurality of hose adapter components.

The hydropneumatic device according to FIG. 9 differs from the arrangement according to FIG. 6 only by the fact that instead of the working part 8, a working part 13 with an adjustable total stroke is integrated. A hose adapter component 17 corresponds to the hose adapter component 14.

The arrangement from FIG. 7 represents a variant to the arrangement from FIG. 4, and by the same token the arrangement from FIG. 9 represents a variant to the arrangement from FIG. 6, wherein all four variants from an associated assembly kit can be provided by selection of the relevant types. The assembly kit comprises in this case four kits of types of four components, specifically in each case a kit of types of intensifier parts, working parts, adapter components and hose adapter components.

Figure 10:
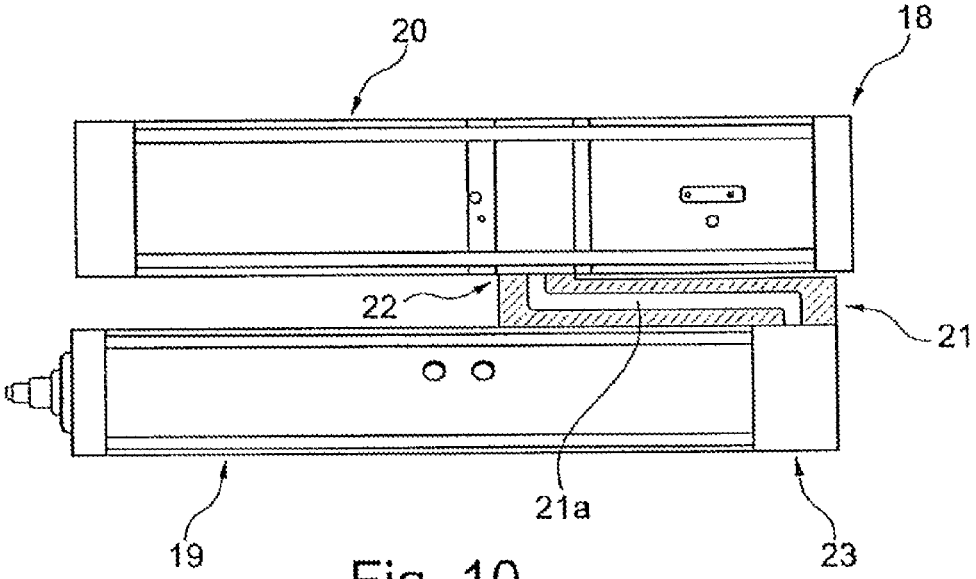
FIG. 10 is a side view showing a further hydropneumatic device according to the invention in the assembled state.

FIG. 10 corresponds to a further alternative embodiment of a hydropneumatic device according to the invention or of a pressure intensifier 18 from the side with a working part 19 and an intensifier part 20 which are hydraulically interconnected via an adapter component 21, which is shown in section. In contrast to the embodiments according to FIGS. 4 to 9, the pressure intensifier 18 is not designed with a side opening on the end side in the longitudinal direction but with a central outlet 22. The central outlet 22 comprises an opening (not visible) leading to the intensifier part 20 at the side, which opening is clearly offset in the longitudinal direction from end sections or cylinder covers of the intensifier part 20. The opening, during a piston movement, serves for the passage of hydraulic fluid from the intensifier part 20 into the adapter component 21 and from there for further passage into the working part 19, or back again during a correspondingly reverse movement of the pistons. In the working part 19, an opening is correspondingly formed at the side on the working part 19 in a section of the working part 19 which is formed as a cylinder cover 23. Inside the rigid adapter component 21, provision is made for an internally disposed connecting line section 21*a* for conducting hydraulic fluid, which on the outside interconnects the lateral opening of the central outlet 22 and the lateral opening in the cylinder cover 23 of the working part 19 with sealing effect. The connecting line section 21*a* extends by a middle section in the longitudinal direction of the working part 19 or of the intensifier part 20 or parallel thereto. The middle line section is at right angles in each case to comparatively short end line sections which in the mounted state are oriented in each case perpendicularly to locating faces on the working part or intensifier part.

Figure 11:
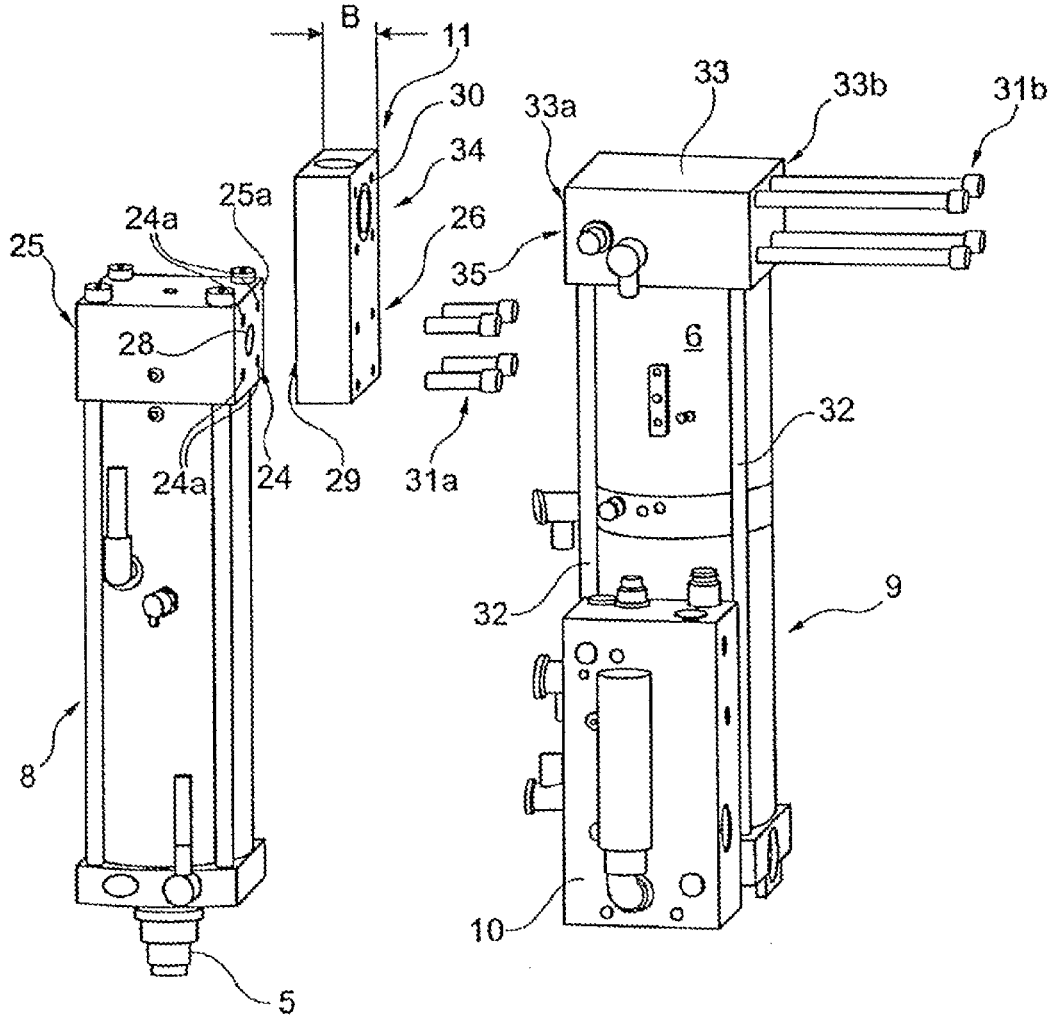
FIG. 11 is an exploded view showing a further hydropneumatic device according to the invention.

FIG. 11 shows in exploded view the hydropneumatic device or the arrangement according to the invention according to FIG. 4 with an adapter component 11, a working part 8 and an intensifier part 9 of larger diameter compared with the working part 8. The adapter component 11, by connecting means, which in this case are formed as screws 31*a*, 31*b*, can be connected in each case to the working part 8 and to the intensifier part 9. To this end, provision is made for coinciding, prepared hole patterns, of which a hole pattern 24 on the working part 8 is explained by way of example. The prepared hole pattern 24 has four screw-in holes 24*a* with a female thread in a lateral planar surface 25*a* of a cylinder cover 25 of the working part 8. The four screw-in holes 24*a* are positioned in the corners of an imaginary cube or of a rectangle on the planar surface 25*a* around an opening 28 for the passage of hydraulic fluid. A hole pattern 26 for the screws 31*a* which corresponds to this is provided in a lower region of the adapter component 11 in each case on opposite main faces 29 and 34 of the adapter component 11. The corresponding hole patterns 26 are formed by four through-openings which penetrate the adapter component 11 in the direction of its width B.

By the screwing of the adapter component 11 to the planar surface 25*a* in the orientation shown according to FIG. 11 by means of the screws 31*a*, the adapter component 11 can be fixed in a positionally accurate manner on the cylinder cover 25.

The screwing of the adapter component 11 to a planar surface 33*a* of a cylinder cover 33 of the intensifier part 9 is carried out by means of the screws 31*b*, wherein the planar surface 33*a* is parallel to the main face 34, just as the main face 29 is parallel to the planar surface 25*a*. The cylinder cover 33 is provided with four rod-like tie-rods 32 which engage therewith (in FIG. 11 only two are visible), wherein the tie-rods 32 fit through openings in a further cylinder cover at the other longitudinal end of the intensifier part 9 so that, by the projecting ends of the tie-rods with the male thread, the two cylinder covers are pressed on the end face against the essentially cylindrical housing 6 by means of screwed-on screw nuts in each case. The corresponding parts of the working part 8 are connected in the same way.

For screwing the intensifier part 9 to the adapter component 11, the longer screws 31*b* are inserted through through-holes from the side of a planar surface 33*b* of the cylinder cover 33 and are screwed into corresponding screw-in holes with a female thread in the upper part of the adapter component 11.

A mounting by means of four screws, for example, which extend from the main face 29 of the adapter component 11 through this and further into the cylinder cover 33 of the intensifier part 9, would also be conceivable.

The planar surface 33*b* lies opposite the planar surface 33*a* in a parallel orientation. The through-holes in the cylinder cover 33 and the associated screw-in holes in the upper part of the adapter component 11 correspond in their relative position or in their hole pattern to the hole pattern 24 in the planar surface 25*a* or to the hole pattern 26 in the lower part of the adapter component 11 on the main faces 29 and 34.

With the adapter component 11 fixedly screwed on, a hydraulic connection between the intensifier part 9 and the working part is realized, and in which during a corresponding reciprocating movement of the intensifier piston and working piston, hydraulic fluid makes its way from the intensifier part 9, via an opening 35 in the cylinder cover 33 and further via the opening 30 in the main face 34, into a connecting line inside the adapter component 11 and from there can flow across to the opening 28 in the cylinder cover 25 of the working part 8 and into a hydraulic chamber in the working part 8.

In the case of a reverse reciprocating movement of the pistons, hydraulic fluid can correspondingly flow back from the working part 8 into the intensifier part 9.

Using the adapter component 11 according to the invention or the uniform hole patterns on the adapter component 11 and on the cylinder covers 25 and 33, the relative position between the intensifier part 9 and the working part 8 can be variably selected. The adapter component 11, starting from a mounting position for example according to FIG. 11 with a square hole pattern or square arrangement of the screws, can be mounted in a manner offset by 90, 180 and 270 angular degrees around a central axis of the opening 28, as a result of which the intensifier part 9 is also correspondingly altered in its orientation in relation to the working part 8.

With such a rectangular hole pattern (not shown) or with such an arrangement of screw-holes in the corners of an imaginary rectangle on the relevant surfaces of the adapter component 11 or on the intensifier part and working part, starting from the mounting position according to FIG. 11, a mounting which is rotated by 180 angular degrees can be realized.

In the same way, starting from a mounting position of the intensifier part 9 on the adapter component 11, the intensifier part 9 can be screwed on in a manner offset by 90, 180 and 270 angular degrees in relation to the central axis of the opening 30 in the adapter component 11. Therefore, a multiplicity of different mounting situations are created by means of the assembly of the parts 8, 9 and 11.

LIST OF DESIGNATIONS

1 Pressure intensifier
2 Working part
3 Intensifier part
4 Housing
4*a*, 4*b*, 4*c* Housing sections
5 Working piston
6 Housing
7 Connecting section
8 Working part
9 Intensifier part
10 Pneumatic control unit
11, 11*a*, 11*b* Adapter component
12 Intensifier part
13 Working part
14 Hose adapter component
14*a* Hose section
14*b*, 14*c* Hose coupling part
15, 16, 17 Hose adapter component
15*a*, 16*a* Hose coupling part
18 Pressure intensifier
19 Working part
20 Intensifier part
21 Adapter component
21*a* Connecting line section
22 Central outlet
23 Cylinder cover
24 Hole pattern
24*a* Screw-in holes
25 Cylinder cover
25*a* Planar surface
26 Hole pattern
27 Fastening screw
28 Opening
29 Main face
30 Opening
31 Fastening screw
31*a*, 31*b* Screws
32 Tie rod
33 Cylinder cover
33*a*, 33*b* Planar surface
34 Main face
35 Opening

The invention claimed is:

1. A hydropneumatic device having pressure intensification, wherein the hydropneumatic device comprises:

a working part with a working piston guided in the working part; and an intensifier part with an intensifier piston guided in the intensifier part, at least the intensifier part having a first end and a second end, wherein a connecting section provides a hydraulic connection between the working part and the intensifier part to provide a connecting line for the passage of hydraulic fluid between the working part and the intensifier part, wherein the connecting section comprises a rigid adapter component adapted to be mounted solely in contact with both a planar outer peripheral side surface of the working part and a planar outer side surface of the intensifier part, intermediate the first end and the second end of the intensifier part, wherein an interior of the rigid adapter component houses the connecting line, and wherein in a mounted state of the rigid adapter component, a first opening provided on the planar outer peripheral side surface of the working part, that passes in a direction perpendicular to a longitudinal direction of the working part and which is in communication with a hydraulic chamber of the working part, is connected to a second opening provided on the planar outer peripheral side surface of the intensifier part, that passes in a direction perpendicular to a longitudinal direction of the intensifier part and which is in communication with a hydraulic chamber of the intensifier part, via the connecting line in the interior of the rigid adapter component.

2. The device as claimed in claim 1, wherein in the mounted state, the rigid adapter component, by means of main faces provided in an oppositely disposed manner on the rigid adapter component, is supported on the working part and the intensifier part.

3. The device as claimed in claim 1, wherein the working part and the intensifier part each include an end section, with respect to the longitudinal direction of the working part and the intensifier part, and wherein the rigid adapter component is supported proximate the respective end sections of the working part and the intensifier part in the mounted state.

4. The device as claimed in claim 3, wherein the rigid adapter component is a square-shaped component with attachment openings through which fastening means extend for mounting the rigid adapter component on the working part and on the intensifier part.

5. The device as claimed in claim 4, wherein the end section of the working part and the end section of the intensifier part are matched to the associated attachment openings on the rigid adapter component for mounting the rigid adapter component on the working part and on the intensifier part by the fastening means.

6. The device as claimed in claim 3, wherein the end section of the working part and the end section of the intensifier part each have corresponding mounting mechanisms for mounting the rigid adapter component thereon.

7. The device as claimed in claim 1, wherein in the mounted state of the rigid adapter component, the connecting line in the rigid adapter component has a section that extends in the longitudinal direction of the intensifier part and of the working part.

8. An assembly kit with components of a hydropneumatic device for providing a hydropneumatic device that includes an intensifier part and a working part that is hydraulically connected to the intensifier part via a connecting section, the working part having a first diameter, wherein the assembly kit comprises a plurality of different intensifier parts, at least one working part, and an adapter kit comprising a plurality of rigid adapter components, wherein a hydraulic connection is provided between a first opening in an outer peripheral side surface in any of the plurality of different intensifier parts and a second opening in an outer peripheral side surface of the at least one working part via a matching rigid adapter component from the adapter kit of the plurality of rigid adapter components, the matching rigid adapter component being configured to be mounted solely in contact with the outer peripheral side surface of the any of the plurality of different intensifier parts, and solely in contact with the outer peripheral side surface of the at least one working part, and wherein at least one of the plurality of different intensifier parts has an intensifier step defined by a second diameter, the second diameter being different from the first diameter.

9. The assembly kit as claimed in claim 8, wherein the adapter kit of the plurality of rigid adapter components comprises different rigid adapter components, wherein, each rigid adapter component of the plurality of different rigid adapter components is matched to one of the different intensifier parts and to the at least one working part, whereby simply by selecting a suitable one of the rigid adapter components from the adapter kit and mounting the selected suitable rigid adapter component on the matching intensifier part and the matching working part, a desired combination of one of the intensifier parts from among the plurality of different intensifier parts with the at least one working part is realized.

10. The assembly kit as claimed in claim 8, wherein a rigid adapter component from the adapter kit of the plurality of rigid adapter components is matched to a mounting section on an intensifier part and a working part, at least one of the intensifier part and the working part defining an axis, so that mounting of the rigid adapter component on the intensifier part and the working part is achieved via at least one connecting element that extends laterally through a width direction of the rigid adapter component, the width direction of the rigid adapter component being substantially normal to the axis defined by the at least one of the intensifier part and the working part.

11. The assembly kit as claimed in claim 10, wherein in the mounted state of the rigid adapter component, a first connecting element engages a first prepared opening in the mounting section of the intensifier part, and a second connecting element engages in a second prepared opening in the working part.

12. The assembly kit as claimed in claim 8, further comprising a hose adapter kit including a plurality of hose adapter components having a flexible connecting line section, wherein the hydraulic connection between any of the plurality of different intensifier parts and the at least one working part is selectively realized with a matching one of the rigid adapter components or with a matching one of the hose adapter components from the hose adapter kit of the plurality of hose adapter components.

* * * * *